US005671653A

United States Patent [19]

Martensen et al.

[11] Patent Number: 5,671,653

[45] Date of Patent: Sep. 30, 1997

[54] HYDRAULIC AXIAL PISTON MACHINE

[75] Inventors: Lars Martensen; Henry Madsen Møller, both of Sønderborg, Denmark

[73] Assignee: Danfoss A/S, Nordborg, Denmark

[21] Appl. No.: 673,735

[22] Filed: Jun. 26, 1996

[30] Foreign Application Priority Data

Jun. 30, 1995 [DE] Germany ..... 195 23 828.1

[51] Int. Cl.[6] ..... F01B 13/04

[52] U.S. Cl. ..... 92/57; 92/71; 384/300; 384/908; 384/909; 74/60

[58] Field of Search ..... 92/12.2, 57, 71; 417/269; 74/60; 384/299, 300, 908, 909

[56] References Cited

U.S. PATENT DOCUMENTS 3,905,659 9/1975 Renk et al. ..... 384/299

4,607,964 8/1986 Kramer et al. ..... 384/904

4,744,288 5/1988 Mauch ..... 92/57

5,013,219 5/1991 Hicks et al. ..... 417/269

5,383,391 1/1995 Goade et al. ..... 92/12.2

*Primary Examiner*—Thomas E. Denion

*Attorney, Agent, or Firm*—Lee, Mann, Smith, McWilliams, Sweeney & Ohlson

[57] ABSTRACT

A hydraulic axial piston machine is disclosed, having a cylinder drum which is mounted for rotation relative to a housing (1), with a bearing (3) having a slide face (4) being arranged between the circumference of the cylinder drum and the housing (1). It is desired that such a machine shall be capable of operating also with fluids that are not such good lubricants as hydraulic oil. For that purpose the slide face (4) is formed by a friction-reducing plastics material and has at least one recess (5, 6, 7) communicating with at least one end edge of the slide face (4).

9 Claims, 1 Drawing Sheet

HYDRAULIC AXIAL PISTON MACHINE

The invention relates to a hydraulic axial piston machine having a cylinder drum which is mounted for rotation relative to a housing, with a bearing having a slide face being arranged between the circumference of the cylinder drum and the housing.

Such a machine is disclosed, for example, in DE 43 01 120 A1.

As environmental awareness increases, in hydraulic machines attempts are being made to replace the generally toxic hydraulic oils by other fluids. The use of water as hydraulic fluid promises particular benefits.

The hydraulic oils used in the past have the advantage, however, that they not only serve as the hydraulic medium but at the same time also have lubricating properties which reduce the friction between moving parts of the hydraulic machine. That lubricating property cannot be provided to the known extent by many other fluids, and especially cannot be provided by water.

It has therefore already been proposed to use friction-reducing plastics materials on certain functional elements of the machine that are subject to friction. Those plastics materials then form a part of a contact surface where the parts moving relative to one another slide against one another with a low degree of friction. The use of such plastics materials is not without problems, however. In particular, the plastics materials can be stressed to only a limited extent by pressure and temperature.

The invention is based on the problem of also being able to operate a hydraulic axial piston machine with a fluid that is not such a good lubricant as hydraulic oil.

That problem is solved in a hydraulic axial piston machine of the type mentioned in the introduction by the slide face's being formed by a friction-reducing plastics material and having at least one recess communicating with at least one end edge of the slide face.

In that solution the ability of the cylinder drum and the housing to slide relative to one another is improved by the use of a friction-reducing plastics material, as already known from other applications in a hydraulic axial piston machine. Positioned between the cylinder drum and the housing, the plastics material of the slide face is, however, exposed to relatively heavy loading, which normally can result in a marked increase in the temperature of the plastics layer, which is undesirable. For that reason a recess is provided in the slide face, which recess communicates with at least one end edge of the slide face. The housing of the axial piston machine is generally filled with hydraulic fluid, for example with water. If the recess communicates with an end edge of the slide face, the hydraulic fluid can pass between the cylinder drum and the housing in the region of the bearing. When the cylinder drum rotates relative to the housing, that hydraulic fluid also is carried or introduced into the slide face, giving rise to a certain flow of fluid between the cylinder drum and the housing in the bearing region. Although the flow and the amounts of hydraulic fluid moved thereby are only relatively small, they are still sufficient to prevent excessive generation of heat. Any heat arising is conveyed away by the fluid. It is possible that the film of fluid which forms between the cylinder drum and the housing in the bearing region acts also as a lubricant, but that phenomenon has not been conclusively clarified. As a result of the heat's being conveyed away, the slide face and therefore the layer of friction-reducing plastics material are maintained at a temperature which places less stress on the plastics material and therefore very considerably lengthens the service life of the machine.

In a preferred embodiment, the recess extends from one end edge of the slide face to the other and passes through the slide face. Using that arrangement, the hydraulic fluid can penetrate from both sides of the slide face, which results in a drastic improvement in the flow characteristics. The cooling therefore becomes more effective. Furthermore, the recess can also be used for removing air from the machine, which especially in the case of a pump is important when it is put into operation for the first time or is set in operation again after being uncoupled from the hydraulic lines. Air that has collected underneath the bearing region can then escape through the recess without the need for additional air removal bores or ducts in that region of the machine.

Preferably the recess extends substantially parallel to the rotational axis. This improves the scope for air removal. Furthermore, with that arrangement the introduction of fluid into the recess is largely independent of the direction of rotation of the cylinder drum.

Advantageously several recesses are provided. The fluid can therefore pass into the region between the cylinder drum and the housing at several sites around the circumference, which further improves the removal of heat and therefore the cooling. The paths which the fluid must cover are shorter.

In an especially preferred embodiment, a continuous surface portion remains which extends circumferentially over at least 120°. That surface portion is assigned to the region between the housing and the cylinder drum that is subject to the greatest loading. In hydraulic axial piston machines, that region therefore extends around the point at which (displaced in the axial direction) the swash plate has its lowest point, that is to say is furthest from the cylinder drum, since it is towards that point that the force resulting from its inclination which the swash plate exerts on the cylinder drum via the pistons, which are moved up and down in the cylinder drum, is directed. Because that region is continuous without interruption by a recess, it is able to absorb the highest forces acting between the cylinder drum and the housing. The introduction of fluid through recesses bordering that continuous surface portion is sufficient to convey away the heat to the necessary extent and to improve the lubrication by means of a lubricating film.

Preferably a recess extends circumferentially over not more than 45°. The cylinder drum is therefore always sufficiently supported over its circumference. For the purpose of operation in a fixed location in a predetermined position, it would in principle be sufficient to provide a support in the region in which the swash plate has its lowest point. As soon, however, as the machine is moved, whether it be for transport purposes or for operation in a non-fixed location, or when it is operated in a position other than the predetermined position (for example vertically), it is necessary to have more extensive support for the cylinder drum relative to the housing and this is ensured by limiting the recesses to a certain size.

It is also preferable for the sum of the circumferential widths of the recesses to be less than 120°. As a result, the cylinder drum is actually mounted very precisely in the housing even though the recesses enable fluid to pass into the region between the cylinder drum and the housing.

The housing is preferably approximately rectangular in outer cross-section, at least over some of its length, with at least one recess being so arranged that it is located in the region where the housing has its least thickness. The various housing thicknesses are a result of the cylinder drum's being circular in cross-section. Accordingly, the slide face must also be circular in cross-section. Therefore in the case of a rectangular outer cross-section there will be two regions in which the housing has its least thickness. In the case of a housing of rectangular cross-section, one region of minimum housing thickness can be somewhat larger than the other. In the case of a square cross-section, those two housing thicknesses are the same. Machines of this type are frequently so mounted that one of their housing sides is horizontal and another is vertical. If the recess is then so aligned that it is located in the region of least housing thickness, the machine can in any event be so mounted that the recess is located at the top in relation to the direction of gravity, which again facilitates the removal of air from the machine through that recess. If two recesses arranged substantially at an angle of 90° to one another are provided, the machine may even be installed in several different ways but air removal will nevertheless be ensured.

Preferably a line of transition from the recess to the slide face has a shape taken from a family of curves that is defined on the one hand by a circular curve and on the other hand by a straight line extending at an angle of approximately 45° to the tangent, the transitions into the slide face being rounded. There are therefore no sharp edges or straight lines which could possibly disturb the bearing. As a result of the stated shape, when the cylinder drum rotates with respect to the housing the water is introduced under a certain pressure into the region between the cylinder drum and the housing, so that the desired removal of heat is ensured.

The invention will be described below with reference to a preferred embodiment in conjunction with the drawing.

Figure 2:
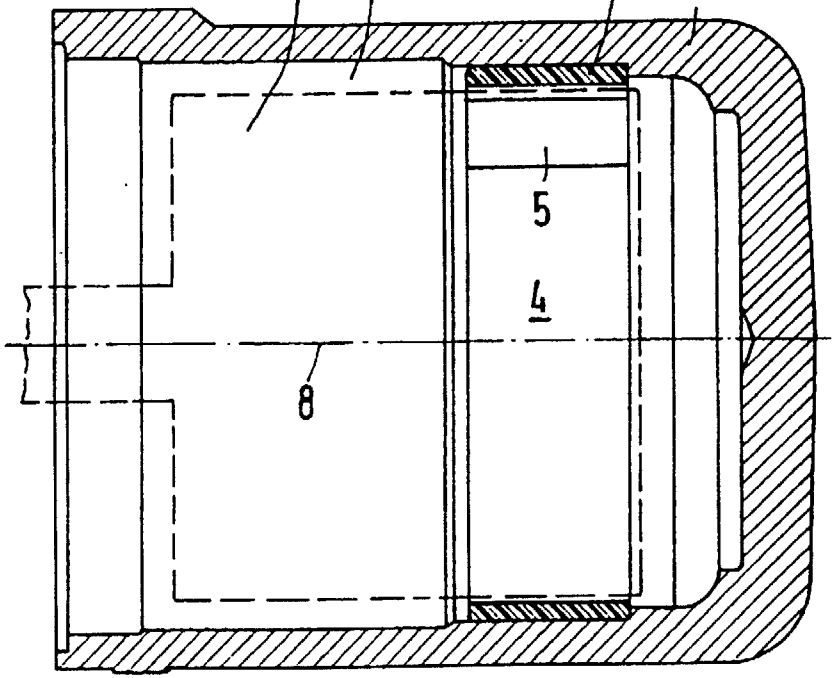
FIG. 2 shows section II—II according to FIG. 1.
Figure 1:
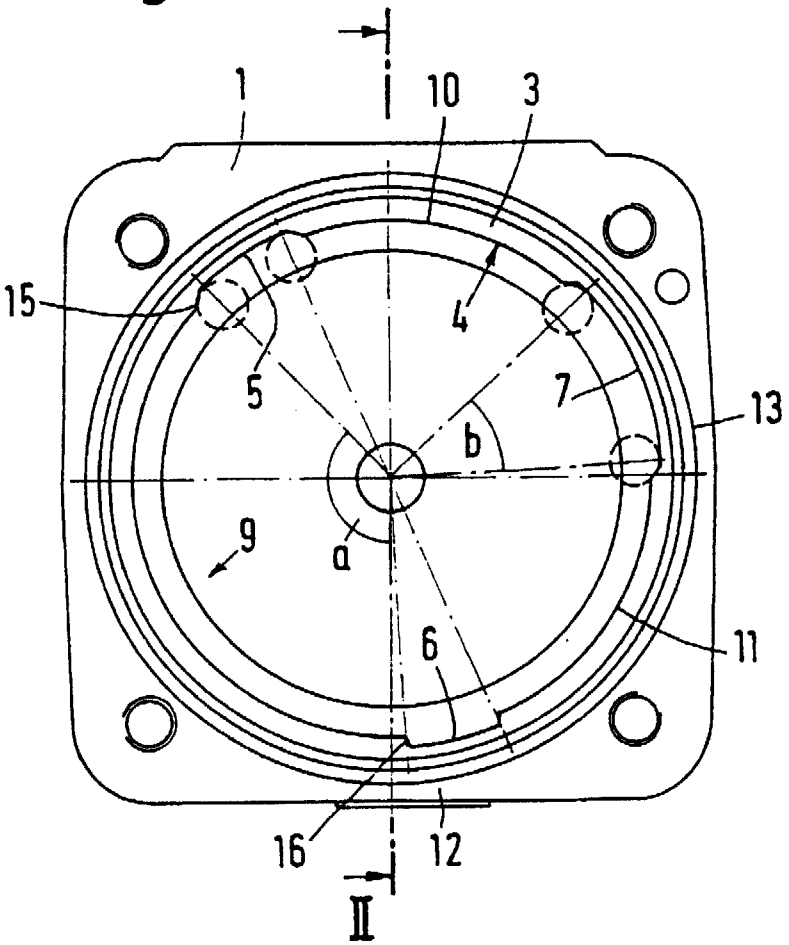
FIG. 1 is a plan view of an open housing seen from the end.

FIGS. 1 and 2 show a housing 1 of a hydraulic axial piston machine, in which housing 1 a cylinder drum 2 (which is shown only by dotted lines in FIG. 2) is rotatably mounted. Between the housing 1 and the cylinder drum 2 there is arranged a bearing 3 having a slide face 4 consisting of a friction-reducing plastics material. The cylinder drum 2 rests against that slide face 4.

The friction-reducing plastics material used is preferably a high-strength thermoplastic plastics material selected from the group of polyaryl ether ketones, especially polyether ether ketones, polyamides or polyamide imides. The plastics material can be reinforced by glass, graphite, polytetrafluoroethylene or carbon, the reinforcing material being in fibre form. In principle it is sufficient for the surface of the bearing 3 to consist of the plastics material, but in many cases it is desirable for the entire bearing 3 to consist of the plastics material. In that case there is no risk of the slide face 4 becoming detached from the bearing 3.

The slide face 4 has three recesses 5, 6, 7 which extend from one axial end edge of the slide face 4 to the other and accordingly pass through the slide face. The recesses 5, 6, 7 are formed by a reduction in the thickness of the bearing 3. They extend substantially parallel to the rotational axis 8 of the cylinder drum 2.

In the slide face 4 there remains, however, a continuous surface portion 9 which extends circumferentially over an angle a of at least 120°. That surface portion 9 is located in a region in which a swash plate (not shown) has its lowest point. The lowest point of the swash plate is the point at which the swash plate is furthest from the cylinder drum 2. As a result of the force, resulting from its inclination, which the swash plate exerts on the cylinder drum 2 via the pistons (also not shown), the cylinder drum 2 is pressed against the slide face in precisely that region.

In order, however, always to be able exactly to determine the position of the cylinder drum 2 in the housing 1, further bearing portions 10 and 11 are provided which support the cylinder drum 2 also in other directions.

In order to ensure adequate support, the circumferential width of the largest recess 7 does not exceed an angle of 45°. In total the sum of the circumferential widths of the recesses 5, 6, 7 should not exceed an angle of 120°.

As can be seen from FIG. 1, the housing 1 is substantially square in cross-section, while the opening 14, which receives the circular cylinder drum, is circular in cross-section, so that there are therefore parts in which the opening 14 is closer to the outer wall of the housing 1 than in other parts. In those regions the housing has its smallest thickness. Although in the case of a rectangular housing there will be various thicknesses in those regions, such a part, which in FIG. 1, for example, has been given reference numerals 12 and 13, can nevertheless be defined as a part of least housing thickness.

As can be seen in FIG. 1, recesses 6 and 7 are located in the regions 12, 13 having the smallest housing thickness. Since such an axial piston machine will frequently be so mounted that its outer sides extend horizontally or vertically, this arrangement allows the recess 6 or 7 always to be at the top in relation to the direction of gravity. Air collecting in the opening 14 that receives the cylinder drum 2 can then easily escape through the recess 6 or 7 on the cylinder drum before the motor is put into operation, especially when it is in the form of a pump. That arrangement therefore facilitates the removal of air from the machine very considerably.

The transition between the recesses 5, 6, 7 can be made in various ways. In the case of recess 5, the transition is shown in the form a circular curve 15, with edges or straight lines being avoided in the transition from the circular curve 15 to the slide face 4. Such transitions are rounded. The transition can also be made by a straight line 16 which extends at an angle of about 45° to the tangent to the slide face 4, as shown, by way of example, for recess 6. The circular curve 15 and the straight line 16 form the limits of a family of curves from which the line of transition between recesses 5, 6, 7 and the slide face 4 can be selected. The line of transition therefore always has a concave or straight-lined shape but is not a convex transition. As a result, the hydraulic fluid, for example water, which can pass into the recesses 5, 6, 7 without difficulty, can also be introduced into the region between the cylinder drum 2 and the slide face 4 where it can be used to convey heat away.

The recesses 5, 6, 7 also have the advantage that any possible differences in pressure can be balanced out around the bearing. One-sided loading of the bearing is thereby avoided.

The recesses 5, 6, 7 in the bearing 3 can be produced as early as when the bearing is moulded. It is also possible for them to be produced at a later stage using a known material-removing method or some other method of shaping.

It will be understood that it is also possible to provide more recesses 5, 6, 7, but the number three has proved sufficient.

We claim:

1. Hydraulic axial piston machine having a cylinder drum which is mounted for rotation relative to a housing, and including cylindrical having a slide face located between an outer circumference of the cylinder drum and the housing, the slide face being formed by a friction-reducing plastics material and having at least one recess communicating with at least one end edge of the slide face.

2. Machine according to claim 1, in which the recess extends from one end edge of the slide face to an opposite edge and passes through the slide face.

3. Machine according to claim 1, in which the recess extends substantially parallel to a rotational axis of the cylinder drum.

4. Machine according to claim 1, including a plurality of said recesses.

5. Machine according to claim 1, including a continuous surface portion which extends circumferentially over at least 120°.

6. Machine according to claim 1, in which said recess extends circumferentially over not more than 45°.

7. Machine according to claim 1, including a plurality of recesses, the sum of the circumferential widths of the recesses being less than 120°.

8. Machine according to claims 1, in which the housing is substantially rectangular in outer cross-section over at least a portion of its length, with at least one said recess being located such that it is in a region where the housing has its least thickness.

9. Machine according to claim 1, in which a line of transition from the recess to the slide face has a shape taken from a family of curves that is defined by a circular curve and by a straight line extending at an angle of approximately 45° to a tangent to the curve, the transitions into the slide face being rounded.

* * * * *